US007609220B2

(12) United States Patent
Engargiola et al.

(10) Patent No.: US 7,609,220 B2
(45) Date of Patent: Oct. 27, 2009

(54) CHANNELIZED LOG-PERIODIC ANTENNA WITH MATCHED COUPLING

(75) Inventors: Gregory Engargiola, El Cerrito, CA (US); Adrian Lee, Albany, CA (US)

(73) Assignee: The Regents of the University of California, Oakland, CA (US)

( * ) Notice: Subject to any disclaimer, the term of this patent is extended or adjusted under 35 U.S.C. 154(b) by 19 days.

(21) Appl. No.: 11/430,524

(22) Filed: May 9, 2006

(65) Prior Publication Data

US 2006/0262023 A1 Nov. 23, 2006

Related U.S. Application Data

(60) Provisional application No. 60/679,264, filed on May 9, 2005.

(51) Int. Cl.
*H01Q 11/10* (2006.01)
*H01Q 1/50* (2006.01)
*H01Q 21/00* (2006.01)

(52) U.S. Cl. ..... 343/792.5; 343/850; 343/852; 343/853

(58) Field of Classification Search ..... 343/792.5, 343/850, 852, 853
See application file for complete search history.

(56) References Cited

U.S. PATENT DOCUMENTS 4,117,491 A * 9/1978 Hanna et al. ..... 343/742
4,652,889 A * 3/1987 Bizouard et al. ..... 343/792.5
5,101,181 A 3/1992 Rauscher
5,438,572 A 8/1995 Rauscher
5,539,415 A * 7/1996 Metzen et al. ..... 343/700 MS
5,706,017 A 1/1998 Buttgenbach ..... 343/753
5,838,675 A 11/1998 Rauscher
6,211,839 B1 * 4/2001 Campbell ..... 343/792.5
6,731,248 B2 * 5/2004 Killen et al. ..... 343/792.5
6,853,348 B1 2/2005 Jung et al.
6,856,298 B1 2/2005 Huan
2005/0254121 A1 * 11/2005 Komiyama et al. ..... 359/356

OTHER PUBLICATIONS

C. Rauscher, "Efficient Design Methodology for Microwave Frequency Multiplexers Using Infinite-Array Prototype Circuits", *IEEE Transactions on Microwave Theory and Techniques,* vol. 42, No. 7, Jul. 1994, pp. 1337-1346.
C. Rauscher, "Logarithmic-Periodic Contiguous-Channel Microwave Multiplexers", *IEEE MTT-S Digest,* 1989, pp. 675-678.
J.E. Ruhl et al., "The South Pole Telescope", *Proc. SPIE,* vol. 5498, 2004, pp. 12-13.

* cited by examiner

*Primary Examiner*—Douglas W Owens
*Assistant Examiner*—Jennifer F Hu
(74) *Attorney, Agent, or Firm*—Michaelson & Associates; Peter L. Michaelson; George Wolken, Jr.

(57) ABSTRACT

A log-periodic antenna coupled to a channelizer is described in which matched scale constants for the antenna and the channelizer are used to achieve substantially identical coupling over each fractional bandwidth channel. Embodiments for simultaneous dual polarization operation are described as well as embodiments suited for planar lithographic fabrication.

2 Claims, 11 Drawing Sheets

(simulated response of 16-channel 100-300 GHz channelizer)

CHANNELIZED LOG-PERIODIC ANTENNA WITH MATCHED COUPLING

CROSS REFERENCE TO RELATED APPLICATIONS

This application claims priority pursuant to 35 USC § 119 from provisional patent application Ser. No. 60/679,264 filed May 9, 2005 the entire contents of which is incorporated herein by reference for all purposes.

STATEMENT REGARDING FEDERALLY SPONSORED RESEARCH OR DEVELOPMENT

This invention was made with Government support under Grant (Contract) No. AST-0096933 awarded by the National Science Foundation, and Grant (contract) No. NNG06GJ08G awarded by the National Aeronautics and Space Administration. The Government has certain rights to this invention.

BACKGROUND OF THE INVENTION

1. Field of Invention

The present invention relates to the field of antennas and, more particularly, to channelized log-periodic antennas.

2. Description of the Prior Art

Astronomical observations in spectral regions ranging from approximately the far infrared (far IR) wavelengths to millimeter (mm) wavelengths are opening a new window on the universe. Studies of the Cosmic Microwave Background (CMB) are testing cosmological models, providing more precise values of cosmological parameters, and helping to elucidate the origin of structure in the universe. It is anticipated that our understanding of star and galaxy formation is likely to be revolutionized by observations at far IR and sub-mm wavelengths since much of the light from early stars that is emitted in visible and ultraviolet (UV) wavelength regions is absorbed by dust and re-radiated at these longer wavelengths. The astronomical science in this wavelength regime has been given the highest priority by the astronomical community.

Many wideband planar antennas are described in the literature, but one challenge is to produce an antenna that is capable of measuring two polarizations of radiation simultaneously and that can be coupled to transmission lines that are practically fabricated using, for example, lithography on a silicon substrate. Producing such an antenna is one objective of the present invention.

An antenna that truly has no change in behavior or performance characteristics with frequency has no characteristic length scale and the features are characterized by azimuthal angle. Examples of such antennas include the bowtie and spiral antennas. In the case of the bowtie antenna, the impedance depends on the opening angle of the bowtie. The bowtie is not a resonant antenna. An ideal bowtie antenna should be infinitely long. The length at which it is truncated limits its bandwidth.

Another class of antenna has components with lengths that are related to wavelength, but the antenna can be scaled (stretched) to obtain a periodic structure with a scaling factor. Antennas in this class include log-periodic (LP) antennas. The properties of these antennas (for example, beam pattern, impedance, among others) may change periodically with wavelength, but this periodicity can be reduced or minimized in specific embodiments of a particular antenna design.

Thus, a need exists in the art for an improved broadband antenna, especially in the far-IR to sub-mm wavelength regions, capable of simultaneously detecting at least two polarizations.

SUMMARY OF THE INVENTION

The present invention relates to a wideband antenna with discrete channels, each of which couples substantially identically to the focal plane. The entire structure is typically planar which allows it to be fabricated using standard lithographic techniques. This structure also allows large arrays to be composed of many such antennas whose beams can cover the focal plane.

Specific embodiments and important components of the antenna include the following:

1) A planar LP antenna typically having four arms suitable for two orthogonal linear polarizations and balanced input. Circular polarizations can also be used in connection with some embodiments of the present invention but, in such cases, the dipole fingers of adjacent antenna arms are interdigitated; some fraction of the RF signal can couple from one arm pair to the orthogonal arm pair, but with a 90 degree shift in phase, resulting in a primary beam that is elliptically or circularly polarized.

2) An integrated, impedance transforming balun: Since the antenna has high impedance and is to be impedance matched on a substrate (such as silicon), impedance reduction is called for. Adding a boom or spine to the antenna reduces the antenna impedance and facilitates impedance matching, by making the balun shorter resulting in fewer quarter wavelength transmission lines in series.

3) Log-periodic channelizer, unbalanced input. An antenna-to-channelizer match requires three things; a balanced to unbalanced transformer (that is, a balun); an impedance transformer (that can be integrated with the balun); matched scale constants ($\tau_a=\tau_c$), that is, the antenna and channelizer have the same scale factor. This scale factor matching ensures that, over each constant fractional bandwidth channel of the channelizer, the impedance of the antenna varies in a substantially identical way. This leads to substantially identical coupling. A heterodyne or bolometer detector can be attached to each discrete channel. The substantially identical optical (electromagnetic) coupling causes every detector to have substantially the same efficiency for collecting electromagnetic photons.

4) In addition, a lens can be used with the channelized planar LP antenna to increase forward gain. A typical LP antenna has a main beam f-number (f/#) of approximately 0.7. The use of a silicon elliptical lens slows the feed antenna beam to f/2. An f/2 antenna-lens combination can efficiently couple to many clear aperture reflector dish telescopes, which also tend to be f/2. Hence, it is an excellent candidate for a wideband quasi-optical telescope feed.

DETAILED DESCRIPTION

The present invention relates to systems, methods, materials and structures linking a log-periodic (LP) antenna to a log-periodic channelizer through a taperline balun to produce an integrated device suitable, for example, as a broadband telescope feed. The photometric channels included in some embodiments of this device would typically have substantially identical coupling to a radio telescope aperture.

A typical log-periodic antenna is an array of switched dipoles of similarly shaped conductors, where adjacent conductors differ in size by a constant scale factor $\tau_a$ and the bandwidth of the antenna is determined by the largest and smallest dipole of this array. The antenna characteristics vary periodically with the logarithm of the frequency with a period of $\log(\tau_a)$.

Figure 100:
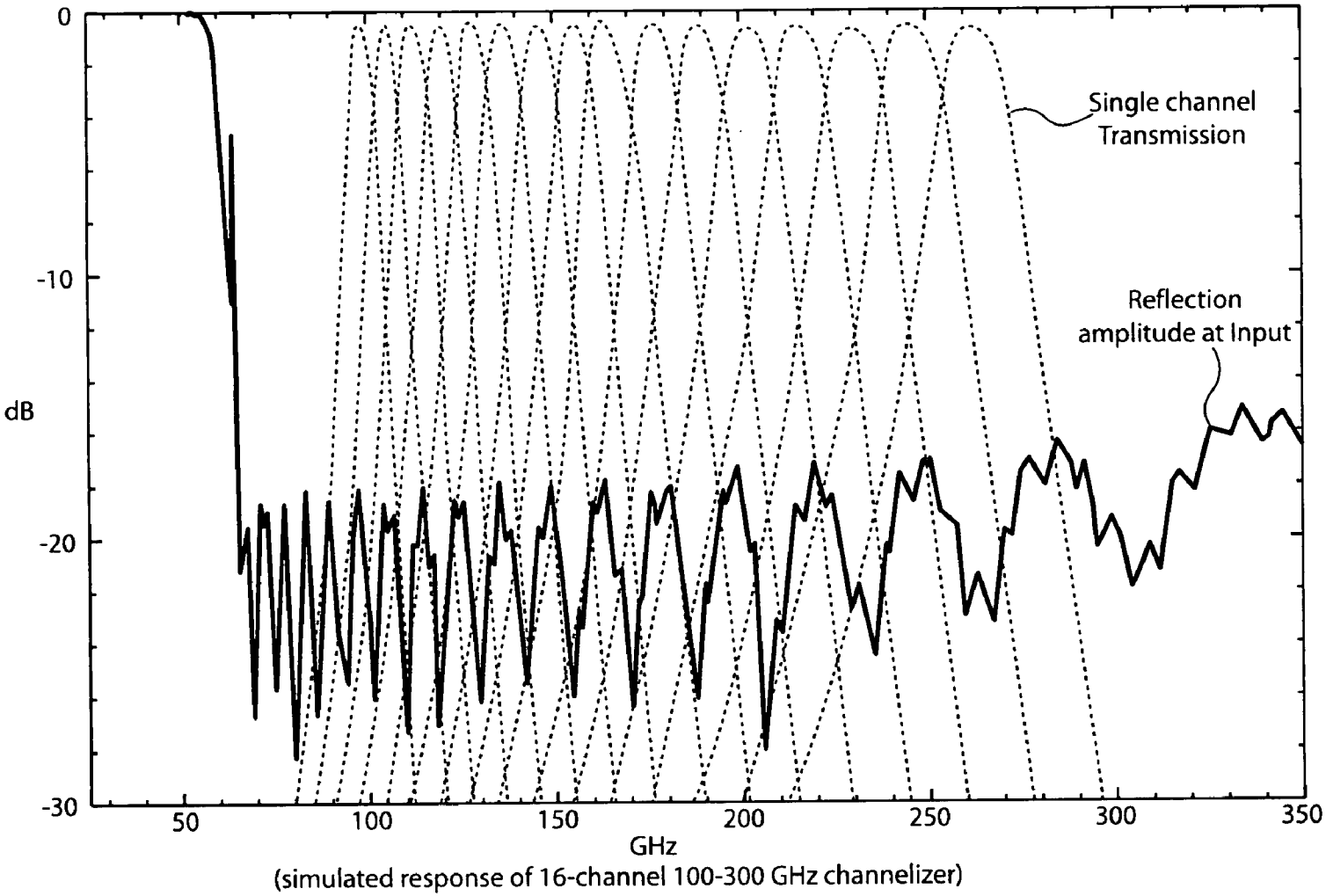
FIG. 100 depicts in graphical form the response of a 16-channel, 100-300 GHz channelizer as generated by computer simulations.

A log-periodic channelizer is effectively a multi-port circuit that includes a broadband input and a series of simple diplexers and channel-defining filters of substantially equal electrical length. The channel-defining filters function so as to separate out contiguous frequency bands of substantially equal fractional width, where the center frequencies of adjacent channels differ by a constant scale factor $\tau_c$. FIG. 100 depicts a simulated response of a 16-channel 100-300 GHz channelizer circuit.

Figure 200:
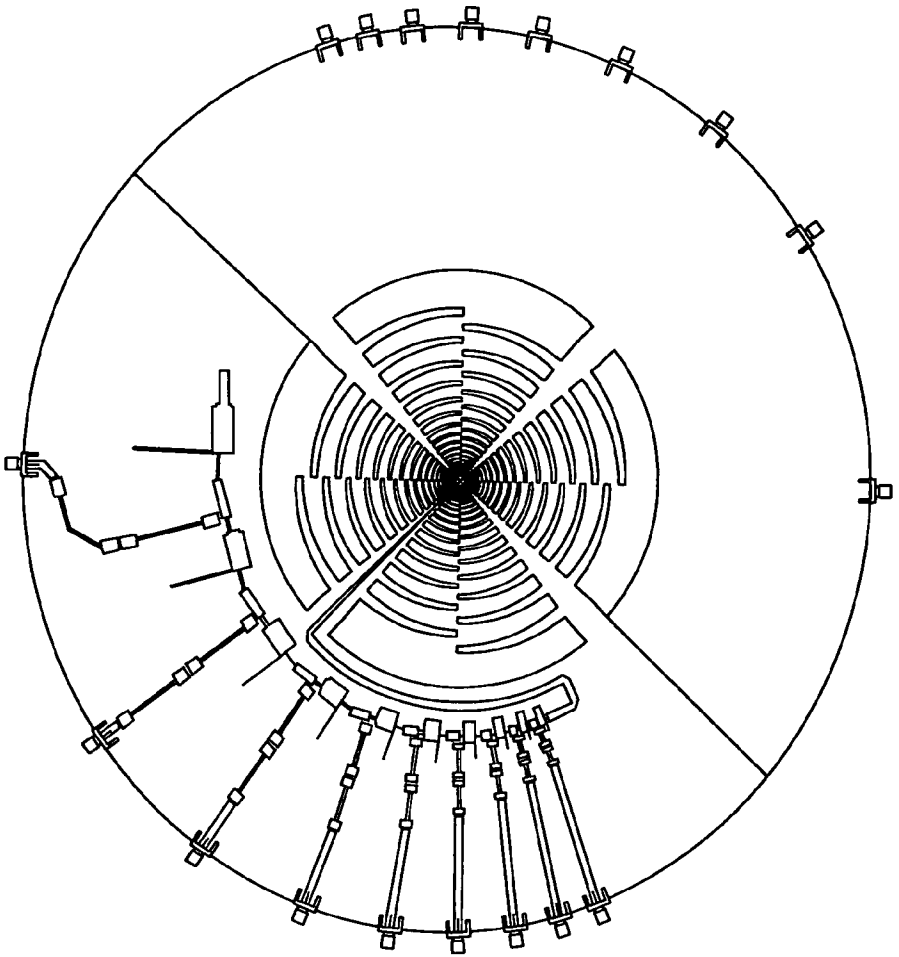
FIG. 200 is a top view of one example of a 2-layer planar circuit embodiment of a dual polarization planar log-periodic antenna and integrated baluns connected to an 11-channel log-periodic channelizer.

Pursuant to some embodiments of the present invention, improvements result from choosing a log-periodic antenna and channelizer such that $\tau_a = \tau_c$. This results in the relative variation of antenna properties with frequency to be substantially the same over any band of the channelizer. Therefore, when antenna and channelizer are linked, the average response weighted properties of any single antenna-coupled channel are substantially identical to those of the other antenna-coupled channels. Such properties include impedance, radiation pattern and SWR (standing wave ratio). In the case of a dual-polarization LP antenna attached to separate identical channelizers, the total cross-polarization coupling will be substantially identical for all corresponding channel pairs. Furthermore, in the case of a planar LP antenna, some embodiments of the present invention include a taperline balun structure integrated into an antenna so that the balanced antenna terminals can be conveniently linked to the unbalanced input of an LP channelizer advantageously realized as a microstrip. FIG. 200 is an example of a 2-layer planar circuit with dual polarization planar LP antenna connected to an 11-channel LP channelizer.

The structures described herein pursuant to some embodiments of the present invention conveniently divide the response of an arbitrary broadband antenna into substantially identical and contiguous narrow bands over which the properties of the antenna vary in a substantially identical manner. This represents an advantageous way to do spectrophotometry and polarimetry with (for example) bolometer detectors, resulting in substantially identical coupling of each frequency and polarization channel to the telescope aperture.

In addition to single antenna elements (or pixels) such as that depicted in FIG. 200, it is advantageous in some embodiments of the present invention to have an array of pixels. For example, a phased array of pixels can be fabricated into a super-pixel in which the signal of each pixel is combined with that of other pixels while maintaining a coherent phase relationship between signals, including the possibility of weighting different signals by differing amounts in the process of coherent combination. It is typically advantageous in such phased arrays to combine each pixel as a unit with its contacting lens with other pixel-lens units into a single unit. Thus, many pixels-lens units can be caused to function effectively like a single pixel having the area of the set of pixels. Such a phased array of pixels can be advantageous in beam shaping for focal plane arrays among other applications.

Some embodiments of the present invention relate to designs and structures for a dual-polarization log-periodic antenna that is coupled to microstrips.

Figure 8:
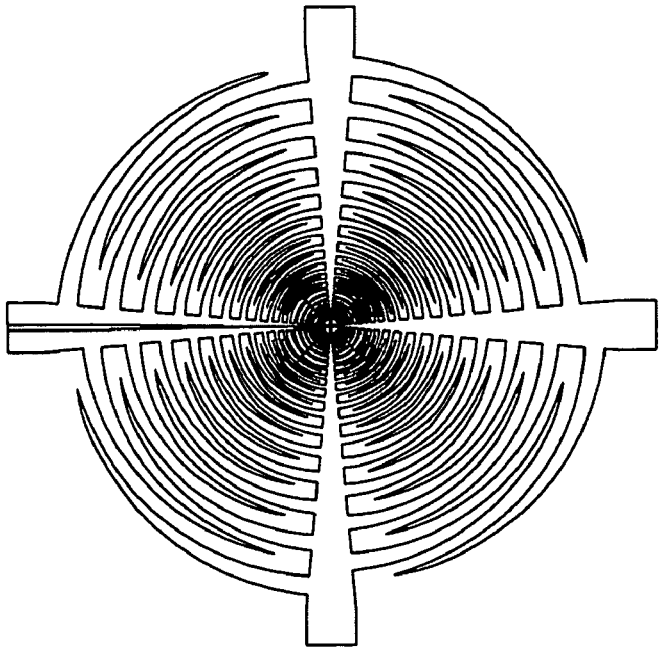

FIG. 8 depicts one example of a mask design as would typically be employed in the fabrication of such a dual-polarization log-periodic antenna. The two opposite arms give a balanced output for a linearly polarized signal. The opposite arms are located on opposite sides of a thin dielectric layer, typically the circuit board as depicted in FIG. 8, but a thin layer of $SiO_2$ could be advantageously employed in connection with a 1:1 superconducting version. Other dielectrics can also be employed as understood by those having ordinary skills in the art.

The bandwidth of the antenna depends on the ratio of the outer radius to the inner radius. In some embodiments of the present invention, a 5:1 bandwidth has been measured in GHz scale models.

The particular example depicted in FIG. 8 includes four radial booms that act as tapered ground planes for a tapered impedance balun. The balun converts the balanced signal to a single-ended signal on a microstrip. The taper reduces the impedance to approximately 20 Ohms, the characteristic impedance of filters and transmission lines conveniently used in some embodiments of the present invention. The terminals of the antenna for a millimeter-wave superconducting antenna typically require fabrication of a short line of approximately 1 μm ($10^{-6}$ meter) width, which is the approximate limit of standard optical lithography at present. For higher precision, e-beam, or other lithographic techniques could be used.

In some embodiments of the present invention, radiation couples to diametrically opposite resonant conducting elements which are approximately one-half wavelength ($\lambda/2$) in length. With each antenna arm, we find it possible and typically advantageous to introduce a narrow, approximately 10 degree, sector of metal ("boom") along the midline without significantly disrupting the radiation pattern of the antenna.

Each boom typically projects somewhat beyond the largest dipole element of the LP antenna and attaches to the edge of a hole in the ground plane, typically a substantially circular hole. The ground plane is advantageously split with parts located on opposite sides of the dielectric layer. Thus, the boom can serve as the tapered conductor of a tapered microstrip balun. A thin microstrip attaches to the opposing antenna arms on opposite sides of the dielectric substrate. The impedance of the antenna with integrated balun is advantageously approximately 100 Ohms. The output impedance of the tapered balun is advantageously approximately 20 Ohms, which is an appropriate value for use with a superconducting Nb microstrip.

Figure 9:
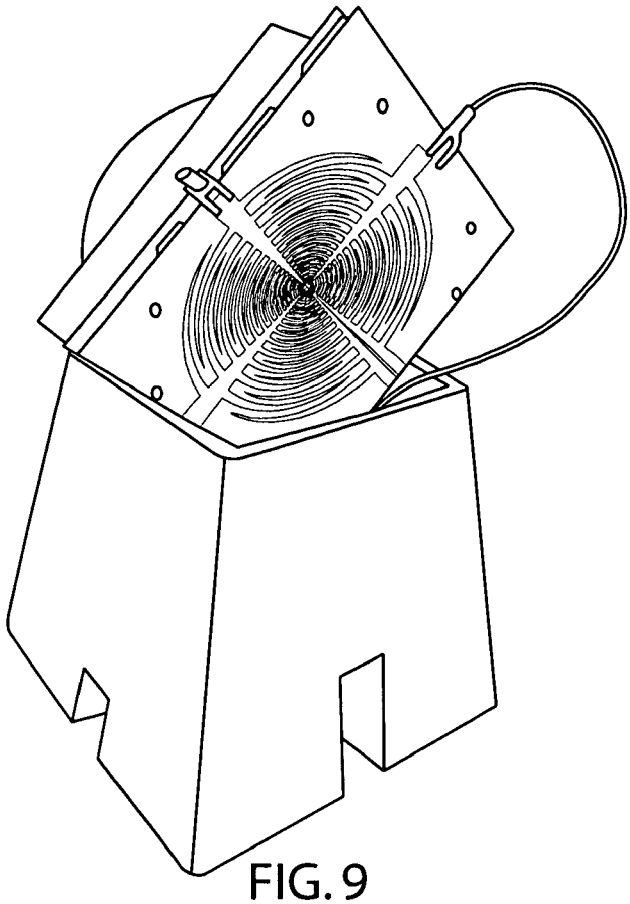
FIG. 9 is a perspective view drawing of a log-periodic antenna with extended contacting lens under test.
Figure 10:
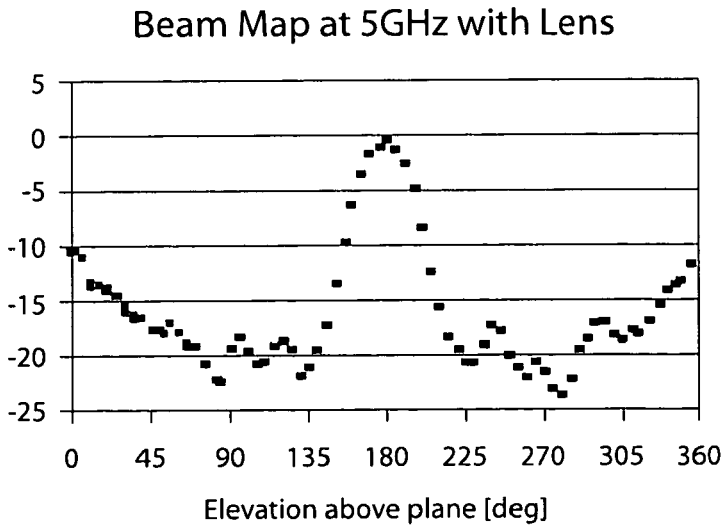
FIG. 10 is a graphical depiction of measured beam maps of scale log-periodic antenna at a frequency of 5 GHz. These measurements match theoretical expectations for the beam shape.

Test examples have been fabricated on fiberglass circuit boards for operation in a frequency range of approximately 1-5 GHz. These examples have been tested using a 40 GHz vector network analyzer as shown in FIG. 9. In FIG. 10 we present measurements of the beam pattern including a hemispherical contacting lens. Both computer simulations and actual measurements show a cross-polarization level of approximately −15 dB. Thus, measurements have been obtained confirming the computer simulations.

It is convenient in some embodiments of the present invention to employ a silicon hemisphere that is extended using a silicon spacer to approximate an elliptical lens. With this configuration, the lens/antenna combination behaves much like a horn antenna but has the advantages of being broadband and having an efficient coupling to a planar transmission line.

Figure 11:
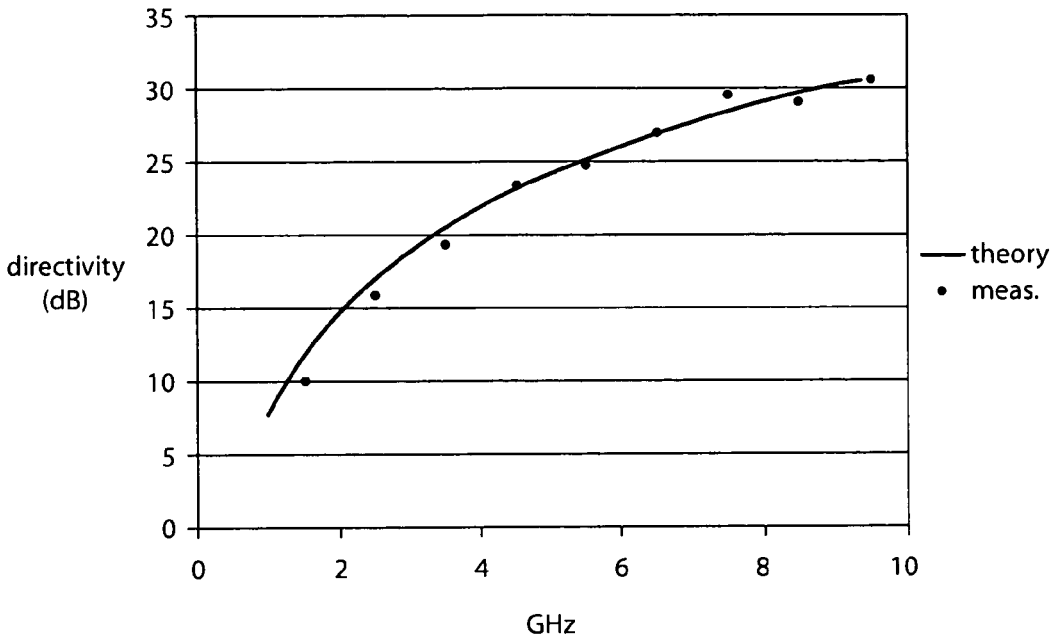
FIG. 11 is a graphical depiction of the measured directivity versus frequency for a particular log-periodic dual-polarization antenna with contacting extended hemispherical lens, as shown undergoing testing in FIG. 9. Both measured data (points) and the results of computer simulations (solid line, "theory") are depicted. As expected, the antenna pattern narrows with increasing frequency (increasing directivity). The lens forms an effective aperture that is constant in size with frequency, and diffraction determines the spread of the antenna's pattern.

In contrast to the frequency-independent beam patterns of the bare antenna, the antenna/lens combination has a beam shape that is largely determined by diffraction with an aperture the size of the lens. Therefore, the beam size decreases with frequency as it would with a horn antenna as depicted in FIG. 11. Also as with a horn antenna, the lens collects power from its entire surface and concentrates it. This allows high aperture efficiency even at high frequencies where the radiating (or radiation collection) area of the antenna is a small fraction of the total area of the antenna.

The combination of log-periodic antenna with the contacting lens offers the possibility of building dual-polarization multichroic focal planes with high aperture efficiency over a broad frequency range. A single pixel or antenna element can have high aperture efficiency over a factor of about 3 in frequency.

Thus, the log-periodic antenna/lens combination has a substantially frequency independent beam similar to that of a smooth-wall horn antenna with small opening angle. For a fixed pixel size, the beam is expected to be wider at long wavelengths and narrower at short wavelengths. For broadband operation of the pixel, a cold aperture stop is therefore advantageous so that the wide beams do not spill over the primary aperture.

Thus, pursuant to some embodiments of the present invention, the contacting, extended hemispherical lens in combination with the log-periodic antenna as described herein is expected to materially enhance the performance of the dual polarization multichroic pixel.

Figure 13:
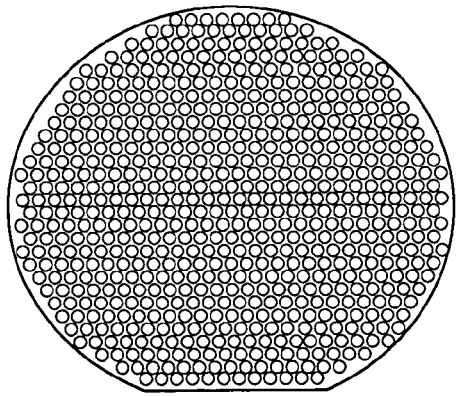
FIG. 13 is a top view graphical depiction of a hemispherical lens array "mock-up" pursuant to some embodiments of the present invention. Mock lenses are 5 mm diameter stainless steel hemispheres. There are 1000 lenses on a standard 6-inch diameter silicon wafer.

FIG. 13 depicts a "mock-up" of a 1000-pixel lens array.

It is advantageous in some embodiments of the present invention to employ broadband log-periodic antennas as described herein in combination with one or more multiplexing filters (channelizers). All circuit elements can conveniently be fabricated lithographically on the same substrate.

Figure 15:
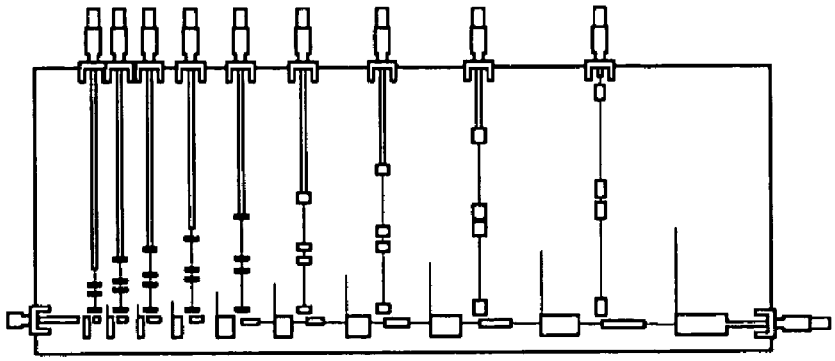
FIG. 15 is a top view graphical depiction of a microstrip nine-channel log-periodic multiplexer with 5:1 bandwidth. The substrate is typically a low-loss, epoxy-based material.
Figure 16:
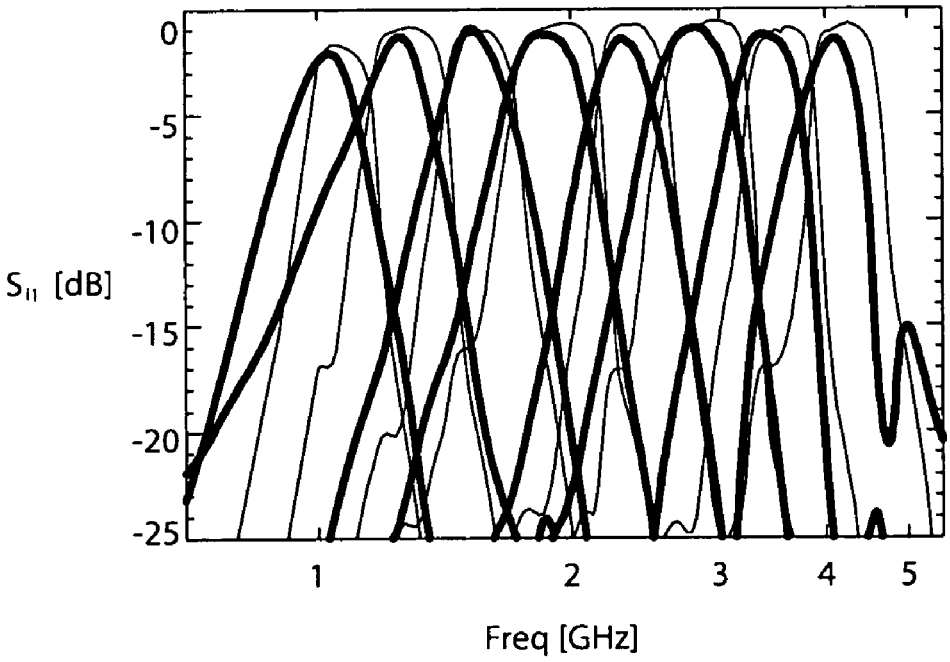
FIG. 16 is a graphical comparison of the measured transmission of a log-periodic multiplexer (thick lines) with computer simulations (thin lines). The reduction at the peaks is largely due to sharing between bands rather than loss.

FIG. 15 depicts a channelizer designed for the 1-5 GHz range pursuant to some embodiments of the present invention. The circuit includes a cascade of self-similar three-port networks. The ratio of the size of the elements between adjacent networks is 1+BW where BW is the fractional bandwidth of a channel. At each T-junction, the vertical section (that is, vertical as depicted in FIG. 15) is a capacitively-coupled strip resonator defining a single channel. The horizontal sections (FIG. 15) act as decoupling resonators and low-pass filters. Good agreement between measured performance and performance predicted by computer simulations is shown in FIG. 16.

The channelizer shown in FIG. 15 was built with discrete chip capacitors, but it is also feasible to construct the circuits using planar lithographed capacitors on (for example) a higher loss G-10 board. In such cases, we also find the computer simulations to be reasonably reliable predictors of measured performance.

Figure 17:
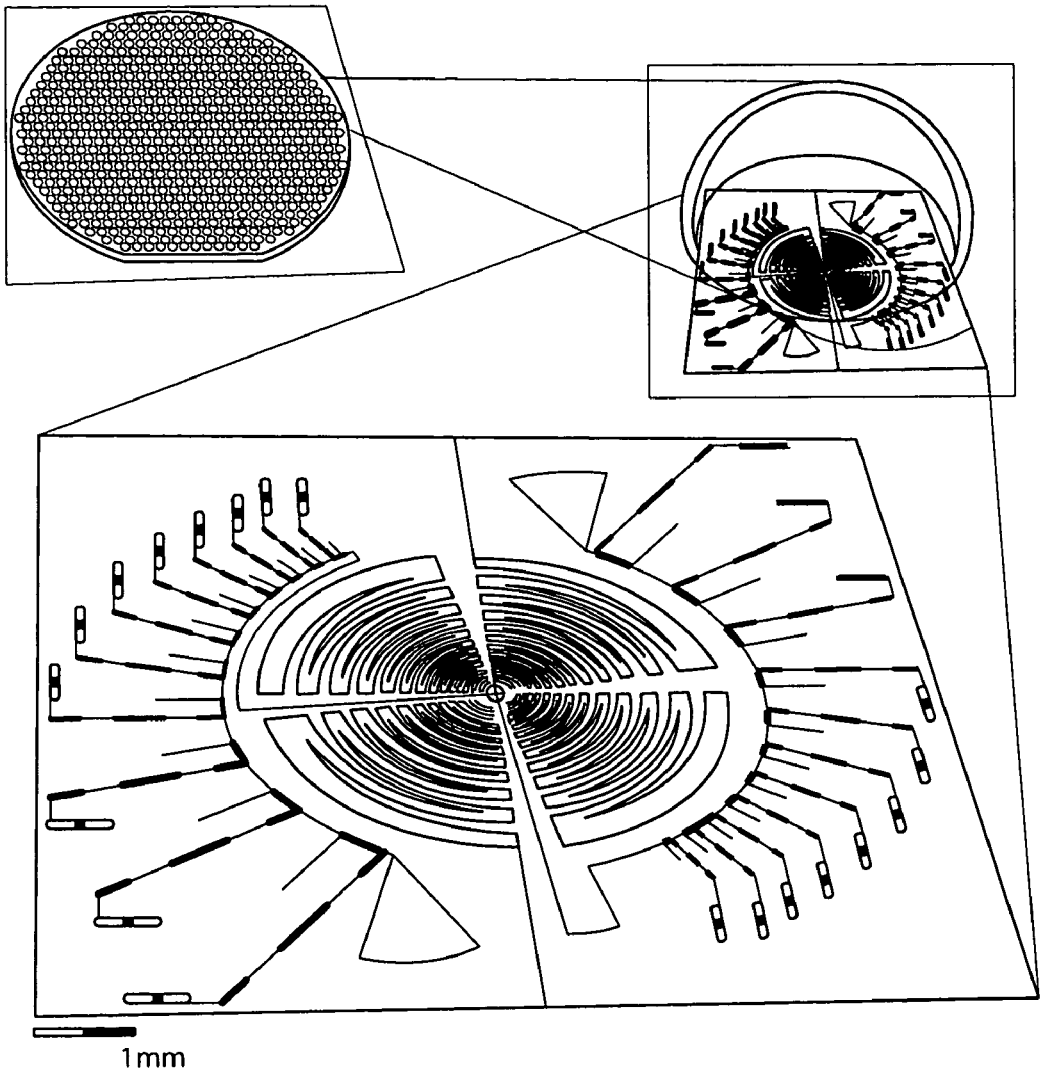
FIG. 17 is a hierarchical depiction of an antenna-coupled bolometer pixel and lens coupled array. The antenna is a dual-polarized log-periodic antenna with an approximate range of 70-360 GHz. It is coupled optically with an extended hemispherical lens. The antenna is connected via a tapered balun to an 11-channel RF channelizer with approximately 28% bands in the range of approximately 90-350 GHz.
Figure 18:
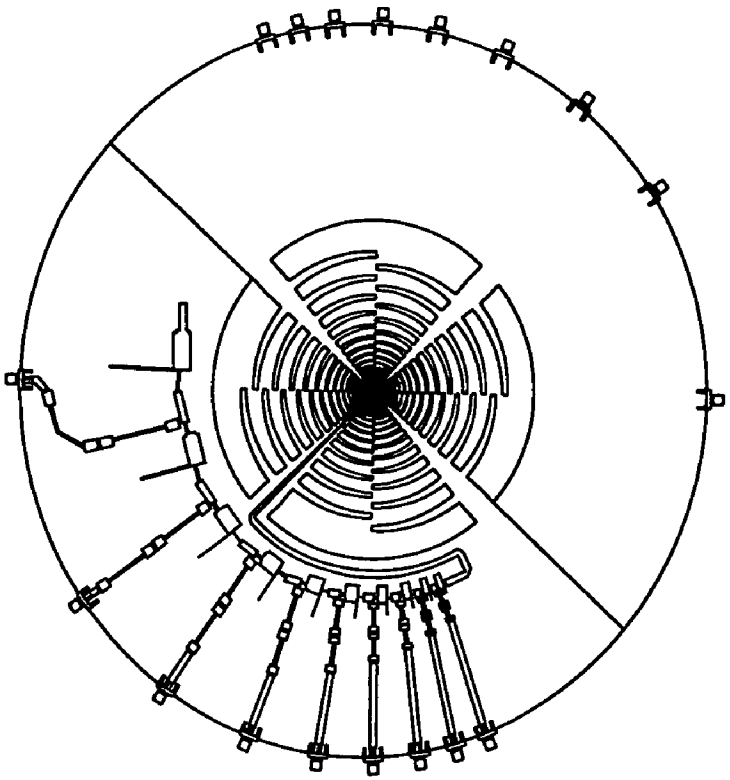
FIG. 18 is a top view depiction of a partially assembled scale model integrated pixel designed for 1-9 GHz operation and is approximately 30 cm in diameter.

We also present herein an example of a typical structure for integrating the wide-band antenna, the channelizer and bolometers. FIG. 17 presents a hierarchical view of an example of a bolometer array. The pixel structure combines a lens-coupled broadband dual-polarization antenna, an 11-band channelizer, and bolometers. The single-ended ports are attached to substantially identical channelizer circuits on opposite sides of the substrate, where the signals correspond to different polarizations. All elements of this structure have been simulated at RF frequencies and tested with models. A partially assembled integrated pixel model is depicted in FIG. 18. For all components of the array, with the possible exception of the lenses, fabrication on a single monolithic silicon substrate is expected to be advantageous.

Examples of other embodiments of the present invention are described below.

EXAMPLES (The contents of all references referred to in these Examples is incorporated herein by reference for all purposes.)

We present the design, simulation, and measurement of a dual linearly polarized log-periodic antenna matched to a log-periodic channelizing filter through a tapered microstrip balun. The design can be implemented monolithically. A prototype of the channelized antenna, which operates over 1-5 GHz, is realized on printed circuit board with a dielectric constant of 4.5. Because we designed the antenna and channelizer with the same log-period ($\tau$=1.2) the variation in antenna impedance and radiation pattern is theoretically the same over every channel ($\Delta\nu/\nu$~0.2). The channel averaged radiation patterns show less variation from channel to channel (1.64-5.26 GHz) than do radiation patterns sampled over a single log-period in frequency (4.39-5.26 GHz). We are developing this channelized log-periodic antenna as a scale model of a polychromatic millimeter-wave pixel for an array receiver of Transition-Edge Sensor bolometers. We are constructing such receivers to measure the polarization of Cosmic Microwave Background radiation.

Astronomical measurements of Cosmic Microwave Background (CMB) emission at millimeter wavelengths are essential to test competing theories of the early universe. Measurements of the CMB polarization anisotropy, in particular, will require a large improvement in receiver sensitivity. Cryogenic bolometer arrays have the potential to achieve the required level of sensitivity. Single frequency dual polarization antennas have been implemented successfully [1]. However, many measurements require multiple frequency bands and the size of the focal plane is limited, so multi-frequency pixels would allow a significant improvement in sensitivity with existing focal plane designs. We are developing a new generation of polarization-sensitive arrays utilizing wideband antennas and channelizers feeding superconducting transition edge sensors to obtain multiple frequency bands in one pixel.

A feed circuit that couples bolometers to a telescope aperture determines their frequency and polarization selectivity. The most promising feed circuits employ simple planar antenna and filter structures, which can be produced monolithically with the detectors [1]. These are made from low loss superconducting niobium microstrips using standard optical lithography. As part of our program to build TES arrays, which can perform spectrophotometric polarimetry, we have fabricated and tested 1-5 GHz scale models of a novel log-periodic antenna circuit with broadband sensitivity and frequency channelized output. Contacting an extended hyper-hemispherical lens of high dielectric constant ($\in$>12) to the antenna makes it a nearly unipolar Log-Periodic Antenna.

Figure 1:
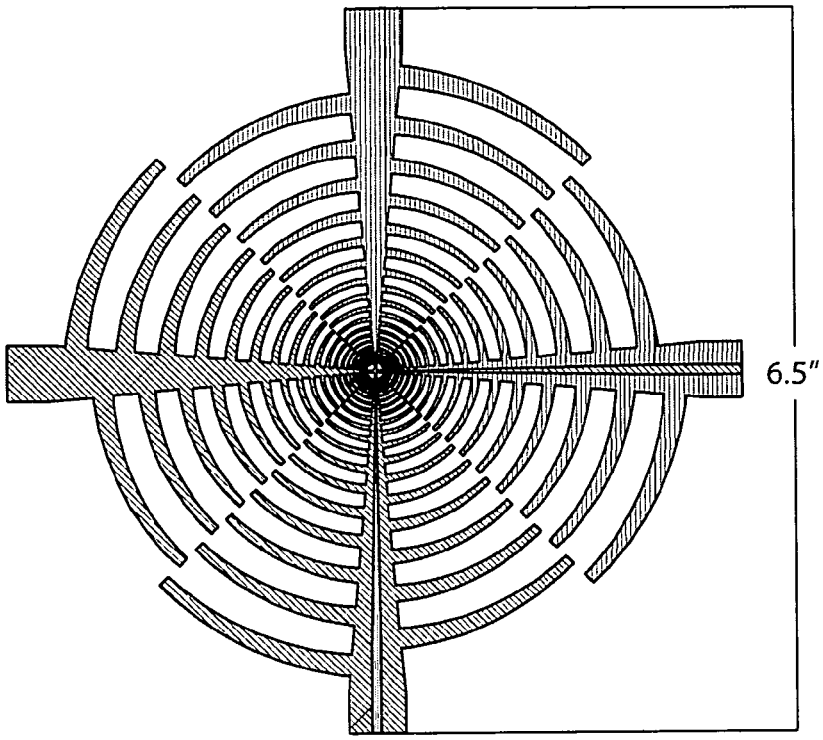
FIG. 1 is a graphical top view depiction of a log-periodic toothed antenna with dual linear polarization. The geometry is self-similar, with a scaling factor of $\tau=1.2$. The frequency band is 1-8 GHz. The typical diameter is 6.5 inches as indicated. Vertical cross-hatch regions and diagonal cross-hatch regions represent metallization on opposite faces of an FR4 circuit board, 0.062" thick.

The log-periodic toothed planar antenna we designed exhibits some variations in radiation pattern, input impedance, and phase center, but the optical throughput varies by no more than 10% for frequencies of 1-8 GHz. FIG. 1 shows the antenna structure, which is self-similar and resembles the log-periodic design of Isbell [2]. Conductor edges in adjacent structure cells are related by a constant ratio $\tau=R_{n+1}/R_n=1.2$, and antenna performance is identical for any two frequencies $f_1$ and $f_2$ within the band of operation, where $\log f_2=\log f_1+m \log \tau$ and m is an integer. Staggered teeth spanning ~$\lambda/2$ on opposing arms form a switched dipole array that broadside couples to radiation of wavelength $\lambda$, producing a forward and backward lobe with a FWHM of ~55°. Therefore, the largest and smallest teeth determine the highest and lowest frequencies of operation. The small gap separating opposing arms spans the balanced antenna terminals. The four arms of the two orthogonal-antennas have 4-fold rotational symmetry. The antenna has a real impedance of ~200Ω and a relatively low SWR of ~1.5, with log-periodic excursions in return loss.

Figure 2:
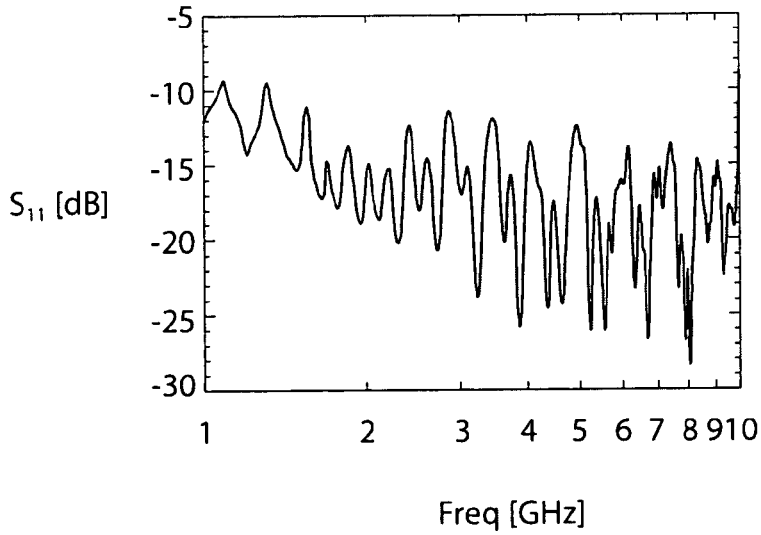
FIG. 2 is a graphical depiction of reflection amplitude of a log-periodic antenna through a microstrip balun as a function of frequency. Log-periodic variations in |S11| correspond to a VSWR of 1.4-1.8 dB for 1.5-8 GHz.

FIG. 2 shows the return loss $S_{11}$ measured for the antenna. Adjacent return loss minima, clearly seen at 2.61, 3.18, 3.85, 4.62, 5.58, and 6.72 GHz, are related by a common ratio equal to the geometric scale constant $\tau$, as expected. We have not yet made detailed polarization measurements of the antenna, but simulations and preliminary measurements indicate cross-polarization coupling is less than −15 dB.

The planar antenna was fabricated on 0.0625" thick FR4 circuit board, which has a dielectric constant $\in_r$=4.5 and a loss tangent of $\delta$=0.008. This low-cost substrate gives high loss, but time of manufacture for prototype antennas on FR4 can be as short as 24 hours. The terminals near the center of the antenna are linked with a tapered microstrip balun [3, 4] to a 50Ω end-launch SMA connector at the edge of the printed circuit. The 50Ω to 200~Ω impedance match is performed with a 16 step transformer optimized in MMICAD [5] as idealized transmission line segments. The impedance transforming balun was synthesized using Zeland Software IE3D [6], where a constant taper antenna boom is assumed for the ground plane conductor. The electrical length of the balun at the lowest frequency is ~$\lambda/2$. To avoid a crossover of signal lines at the center of the antenna, we fabricated opposing antenna arms on opposite faces of the printed circuit board. The two baluns are orthogonal with their ground planes on opposite faces of the board.

Figure 3:
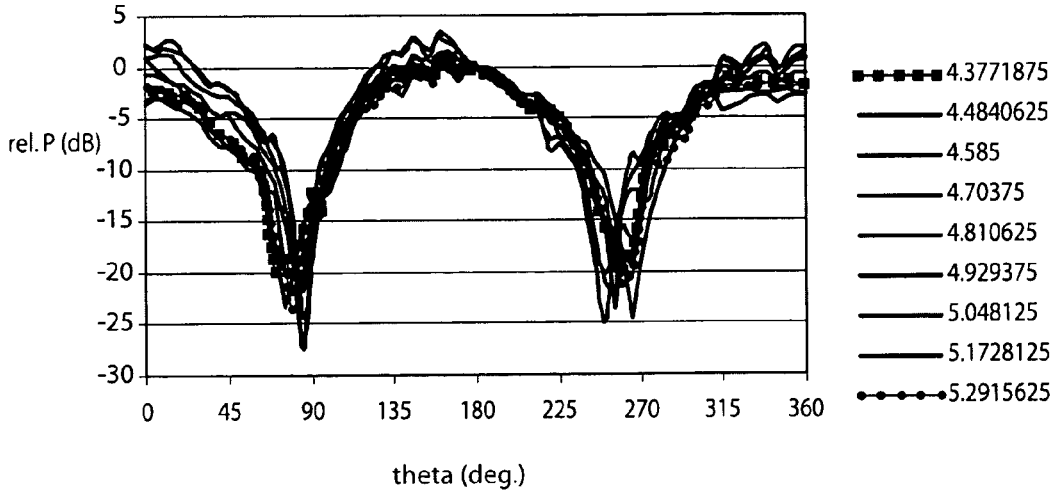
FIG. 3 is a graphical depiction of H-plane radiation patterns measured at intervals over a log-period in frequency centered at 4.81 GHz. Simulated and measured patterns are depicted.

Radiation patterns of our log-periodic planar antenna were measured with the use of an Agilent 8722ES network analyzer [7], an Endwave Corp. 110-317 1-10 GHz amplifier [8], a 1-20 GHz cavity backed Archimedean spiral antenna for transmission from the VNA Port 1, and a rotary table which can set the azimuthal angle of offset for our antenna to within 0.5 degrees. Patterns were sampled at 5° intervals. H-plane patterns were measured, with the coaxial transmission line linking our antenna to the VNA Port 2 brought in along the vertical axis of rotation, to couple energy from the horizontal teeth. Measuring E-plane patterns requires attaching a coaxial cable to a vertical circuit board edge to receive energy from the vertical teeth, causing interference and raising side lobe levels. FIG. 3 shows relative gain patterns for eight frequencies spanning a log-period and centered at 4.81 GHz. The dashed and dotted traces denote patterns at frequencies separated by exactly a log-period. Clearly, the measured radiation pattern varies over this interval as the resonant region of the antenna scans across a single structure cell; the pattern closely repeats at the beginning and end of the log-period.

Figure 4:
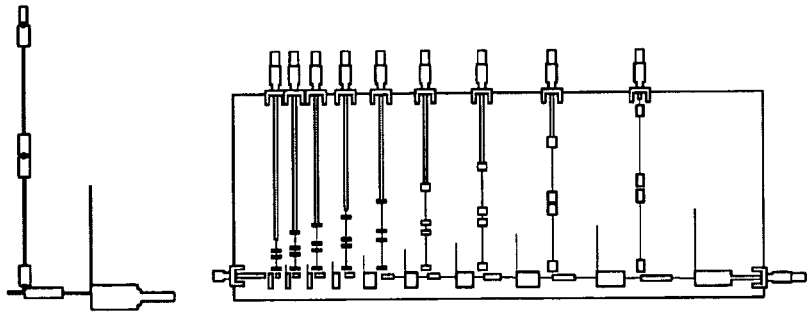
FIG. 4 is a schematic depiction of a log-periodic channelizer realized in microstrip. Shown on the left is the basic circuit cell, which diplexes the broadband signal entering at the left of the horizontal branch. The vertical branch, a pair of capacitively coupled series resonators, passes a narrow high frequency band with $\Delta\nu/\nu \sim 0.20$ (where "~" indicates "approximately equal to"). All frequencies below this band are passed from the right.

We chose to develop a compact, elegant channel-defining filter, realized by cascading topologically identical, log-periodically scaled diplexers shown in FIG. 4. Rauscher first investigated this style of channelizing filter [9]. The basic circuit cell divides the wideband signal entering at the left of the horizontal branch. The vertical branch, a pair of capacitively coupled resonators in series, passes a narrow frequency band with $\Delta\nu/\nu$~0.2. Frequencies below this band are passed to the right by a low pass network. The photo shows a complete channelizer circuit with 11 ports. From left to right, adjacent channelizer cells differ in linear scale and frequency by a factor of ~1.20. Since the electrical distance from the input port to each channel output (without the 50Ω microstrip extensions) is the same (~1.8$\lambda$), the circuit loss will be similar for all passbands.

Figure 5:
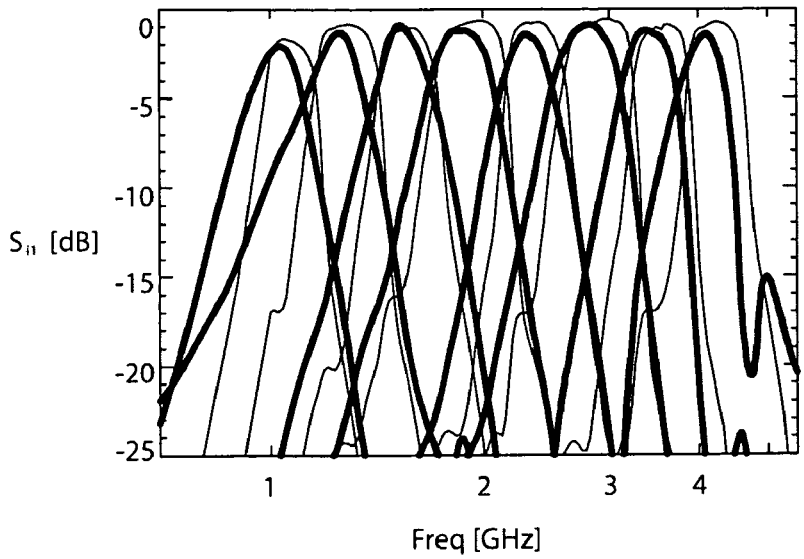
FIG. 5 is a graphical depiction of the measured transmission of the 1-5 GHz log-periodic channelizer depicted in FIG. 4. Ohmic and dielectric losses cause a 0.34 dB reduction in transmission. Curves with thick lines show transmission measurements of the circuit depicted in FIG. 4. Curves with thin lines show the results of MMICAD simulations.

The channelizer shown in FIG. 4 was fabricated on 0.060" thick Rogers Corp. TMM-4 circuit board material [10], which has a dielectric constant of $\in_r$=4.5 and a loss tangent of $\delta$=0.0017. A manageable number of design parameters define the circuit. Two impedances, two electrical lengths, and two capacitances define the band pass filter in the unit cell. Six impedances and six electrical lengths define the low-pass filter branch. Corresponding capacitor values in adjacent cells are related by the log-periodic scale factor since their admittances $Y^{1,2}_{n}=j\omega_n C^{1,2}_{n}$ and $Y^{1,2}_{n+1}=j\omega_n \tau C^{1,2}_{n+1}$ must be equal. Corresponding microstrip lengths are similarly scaled. Our design was constrained to have microstrip lines no wider than 0.180" (37Ω) to avoid excessive parasitics for the high frequency cells and no thinner than 0.008" (140Ω) to comply with typical photolithographic limits for commercially processed circuit boards. Transmission measurements and linear simulations of the channelizer circuit are shown in FIG. 5. The circuit was simulated with MMICAD. The simulation results included frequency dispersion and junction effects. For simplicity, we designed the circuit to incorporate ATC Corp. capacitors [11], which are available in multiples of 0.1 pF. The smallest capacitance required for this circuit is 0.1 pF for the 4.81 GHz channel filter. While we have not demonstrated a fully monolithic circuit, we recently simulated a channelizer of similar design and performance that employs interdigital capacitors, which we intend to use in future scale models. The measured and simulated transmission peaks in FIG. 5 show good agreement. The measured transmission-weighted frequencies of the channels are 1.046, 1.241, 1.563, 1.891, 2.347, 2.812, 3.147, 4.089, and 4.813 GHz. These agree to within 5% of prediction. The measured return loss varies between 15-30 dB at channel band centers and is ~10 dB where bands overlap. The overall insertion loss is −0.56 dB, where we estimate −0.40 dB is due to dielectric and Ohmic losses.

Figure 6:
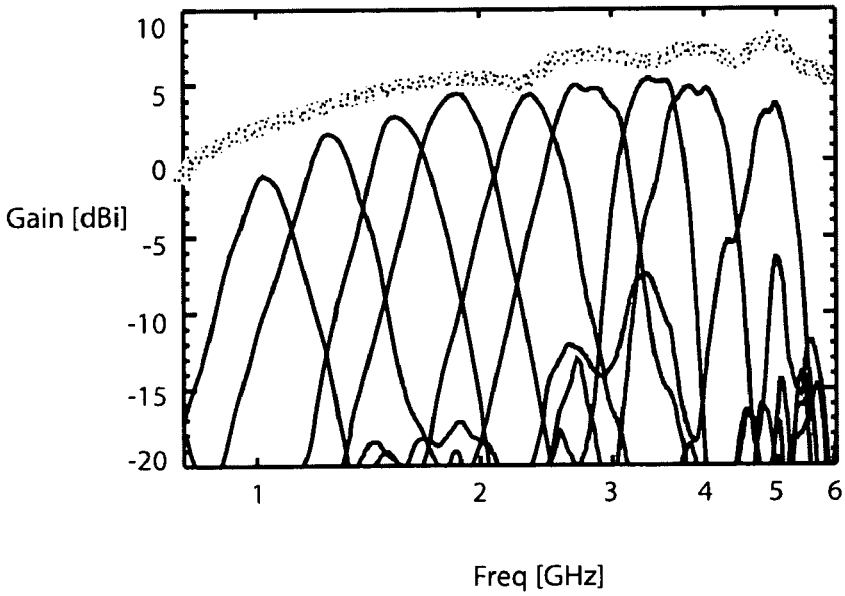
FIG. 6 is a graphical depiction of the on-axis gain of the log-periodic antenna alone and through the log-periodic channelizer. The dotted broad line across the top of FIG. 6 is the response of the antenna. Beneath this antenna response is plotted the response of the antenna through the channelizer.

The 50Ω wideband signal ports of our log-periodic antenna and channelizer, fabricated on substrates of the same thickness and dielectric constant, were joined by SMA connectors to form a channelized wideband antenna. The on-axis antenna gain is shown in FIG. 6. The dotted broad line indicates the gain of the antenna with integrated balun, alone, while the curves beneath show the gain resulting from the antenna signal filtered through the channelizer. The peak gain through most channels follows the on-axis antenna-only gain, with the gain reduction consistent with sharing of power between adjacent channels and the channelizer insertion loss. Reduced gain of the low and high frequency channels suggests impedance mismatch due to the omission of substitution networks to match into or terminate the low-pass trunk-line section. These could be implemented as two resistively terminated guard channels defining the band edges of the channelizing filter.

Figure 7:
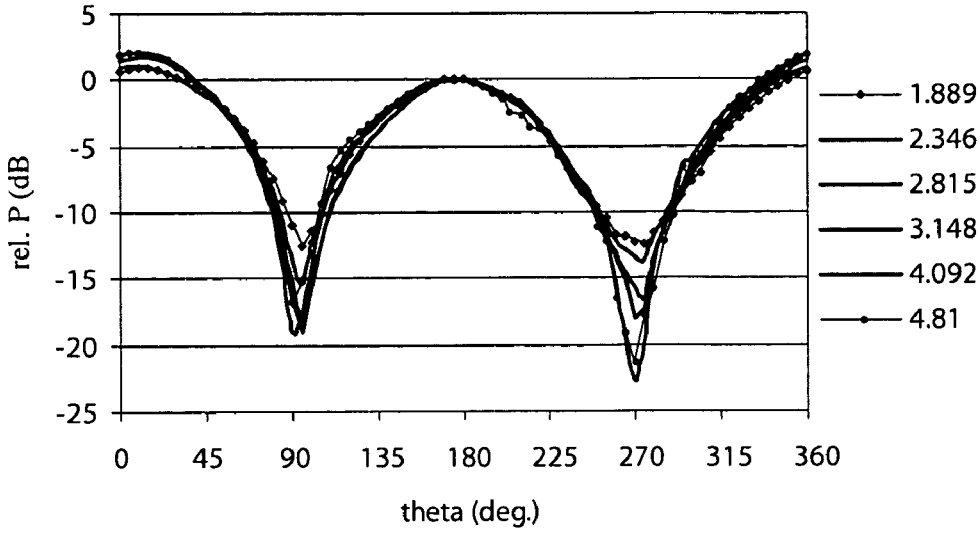
FIG. 7 is a graphical depiction of the channel integrated H-plane (azimuthal) radiation patterns for six of the nine channels.

The variation of the antenna pattern over a log-period in frequency, shown in FIG. 3, can lead to a significant variation in coupling efficiency to a telescope or lens aperture. We have purposely designed our log-periodic antenna and channelizer to have the same geometric scale factor to facilitate matching between them. Any variation in antenna pattern or impedance match between antenna and channelizer will be replicated over every channel. This reduces the need for a detailed bandpass calibration. To illustrate this point we present in FIG. 7 measurements of the channel integrated beam patterns in H-plane. Patterns were measured through six of the nine channels, with the low and high frequency patterns plotted as dashed and dotted lines, respectively. For each azimuthal orientation of the antenna the response was calculated for a channel by integrating all power within −20 dB edges of the peak, which corresponds roughly to the center frequencies of the adjacent channels. These patterns are analogous to those that would be measured with bolometers attached to the channelizer outputs. There is significantly less channel-to-channel variation among the channel averaged patterns than over the set of patterns measured over a single log-period shown in FIG. 3. The frequency span of the channelizer is 1-5 GHz, only a part of the antenna band.

We have developed a 1-5 GHz channelized log-periodic antenna with dual linear polarization and the potential to be fabricated monolithically. While our current channelizing filter includes commercial capacitors, we have simulated a modified circuit of similar performance where these are substituted with integrated interdigital capacitors. In our scale model the upper frequency limit of our channelizer was fixed by the smallest easily obtainable capacitor value (0.1 dB) and photolithographic limits (0.008") on FR4. Inter-digital capacitors would make it possible to design a channelizer covering the entire 8:1 frequency range of the antenna. Our channelized antenna shows potential as a scale model for the planar RF circuitry needed to make a 40-320 GHz polychromatic pixel for polarimetry with TES bolometer array receivers. Contacting an extended hyper-hemispherical lens of high dielectric constant (∈>12) to the antenna makes it nearly unipolar, increasing the antenna gain and suppressing substrate modes [12]. The antenna gain varies with frequency, but can be well matched to a telescope over at least a 3:1 band.

REFERENCES

[1] Myers, M. Ade, P. A. R., Engargiola, G., Holzapfel, W. L. Lee, A. O'Brient, R., Richards, P., Smith, A., Spieler, H, and Tran, H., *Applied Physics Letters,* 86, 114103 (2005)
[2] Isbell D. E. *IRE Trans*. AP-8, 260-267 (1960).
[3] Engargiola, G. *Rev. of Sci. Inst.,* 74, 5197-5200 (2003)
[4] Gans, M. J., Kajfez, D., and Rumsey, V. H., *Proc. IEEE* 53, 647 (1965)
[5] Optotek Corp., Ottawa, Ontario, Canada K2K 2A9
[6] Zeland Software, Inc., Fremont, Calif. 94538
[7] Agilent Corp, Palo Alto, Calif. 94306
[8] Endwave Corp, Sunnyvale, Calif. 94085
[9] Rauscher, C. *IEEE MTT,* 42, 7, 1337-1346 (1994)
[10] Rogers Corp., Rogers, Conn. 06263
[11] ATC Corp., Huntington Sta., NY 11746
[12] Filipovic, D., Gearhart, S., and Rebeiz, G. IEEE MTT 41, 10, (1993)

What is claimed is:

1. A combination of log-periodic antenna and log-periodic channelizer, wherein said combination comprises a planar log-periodic antenna electrically coupled through one or more taperline baluns to at least one log-periodic channelizer separate from said log-periodic antenna and located on the same substrate as said log-periodic antenna, and wherein said at least one log-periodic channelizer is a multi-port circuit including a series of diplexers and channel-defining filters of substantially equal electrical length, and wherein the size scale factor of adjacent conductors of said log-periodic antenna is substantially the same as the scale factor between center frequencies of adjacent channels of said at least one log-periodic channelizer, and whereby said coupling is substantially identical between each fractional bandwidth channel of said at least one log-periodic channelizer and said log-periodic antenna.

2. A combination as in claim 1 wherein said log-periodic antenna is a dual polarization antenna having components thereof disposed on opposite faces of a dielectric layer.

* * * * *